United States Patent [19]

Aoyama

[11] 4,245,607

[45] Jan. 20, 1981

[54] EGR CONTROL SYSTEM FOR INTERNAL COMBUSTION ENGINE

[75] Inventor: Shunichi Aoyama, Yokohama, Japan

[73] Assignee: Nissan Motor Company, Limited, Yokohama City, Japan

[21] Appl. No.: 37,359

[22] Filed: May 9, 1979

[30] Foreign Application Priority Data

May 12, 1978 [JP] Japan ..... 53-64360[U]

[51] Int. Cl.[3] ..... F02B 47/08; F02M 25/06

[52] U.S. Cl. ..... 123/568

[58] Field of Search ..... 123/119 A

[56] References Cited

U.S. PATENT DOCUMENTS

| | | | |
|---|---|---|---|
| 4,031,873 | 6/1977 | Banzhaf et al. | 123/119 A |
| 4,043,304 | 8/1977 | Stumpp et al. | 123/119 A |
| 4,092,960 | 6/1978 | Nohira et al. | 123/119 A |
| 4,130,093 | 12/1978 | Aoyama | 123/119 A |
| 4,142,491 | 3/1979 | Hibino | 123/119 A |
| 4,150,646 | 4/1979 | Aoyama et al. | 123/119 A |
| 4,163,435 | 8/1979 | Nakajima et al. | 123/119 A |
| 4,176,638 | 12/1979 | Kitamura et al. | 123/119 A |
| 4,177,777 | 12/1979 | Maruyama et al. | 123/119 A |
| 4,180,033 | 12/1979 | Aoyama | 123/119 A |
| 4,186,699 | 2/1980 | Aoyama | 123/119 A |

*Primary Examiner*—Wendell E. Burns

[57] ABSTRACT

An EGR control system for an internal combustion engine is provided with a control valve member movably disposed in an intake passageway downstream of a throttle valve. The control valve member is movable in the axial direction of a portion of the intake passageway angularly connected to an intake manifold, in accordance with the variation of engine load conditions. For example, the control valve member is connected to a diaphragm member which receives intake manifold vacuum so that the control valve member is movable in response to the intake manifold vacuum.

14 Claims, 6 Drawing Figures

EGR CONTROL SYSTEM FOR INTERNAL COMBUSTION ENGINE

This invention relates to an improvement in an EGR (Exhaust Gas Recirculation) control system for an internal combustion engine, for controlling the amount of exhaust gases recirculated back to the combustion chambers of the engine, more particularly to a control valve used in the EGR system, for controlling EGR rate in accordance with engine operating conditions.

It is the prime object of the present invention to provide an improved EGR control system for an internal combustion engine, by which EGR can be precisely controlled in accordance with engine operating conditions, without causing deterioration in driveability of a motor vehicle.

It is another object of the present invention to provide an improved EGR control system for an internal combustion engine, by which EGR rate can be varied in accordance with engine operating conditions, preventing the unbalance in power output among a plurality of engine cylinders.

It is a further object of the present invention to provide an improved EGR control system for an internal combustion engine, which is provided with a control valve in an intake passageway to control EGR rate in accordance with engine load conditions, by which air-fuel mixture prepared by a carburetor is unformly induced into branch runners of an intake manifold, causing uniform distribution of the air-fuel mixture into a plurality of engine cylinders.

It is a further object of the present invention to provide an improved EGR control system for an internal combustion engine, which is provided with a valve member for controlling the flow resistance of intake air, movable in the axial direction of a portion of an intake passageway angularly connected to an intake manifold, in accordance with engine load conditions.

It is a still further object of the present invention to provide an improved EGR control system for an internal combustion engine, by which sufficient engine power output can be obtained at an engine operating range in which high power output is required, particularly at full throttle engine operating range.

These and other objects, features and advantages of the EGR control system according to the present invention will become more apparent from the following description taken in conjunction with the accompanying drawings in which like reference numerals are assigned to like parts and elements throughout all the figures, in which.

It is well known in the art to recirculate a portion of exhaust gases of an internal combustion engine back to the combustion chambers of the engine in order to decrease the emission level of nitrogen oxides (NOx) contained in the exhaust gases discharged from the engine. This is accomplished by a so-called EGR (Exhaust Gas Recirculation) systems. The EGR system is provided with an EGR control system for precisely controlling the amount of the exhaust gases recirculated back to the combustion chambers of the engine in accordance with the requirement of the engine.

Figure 1:
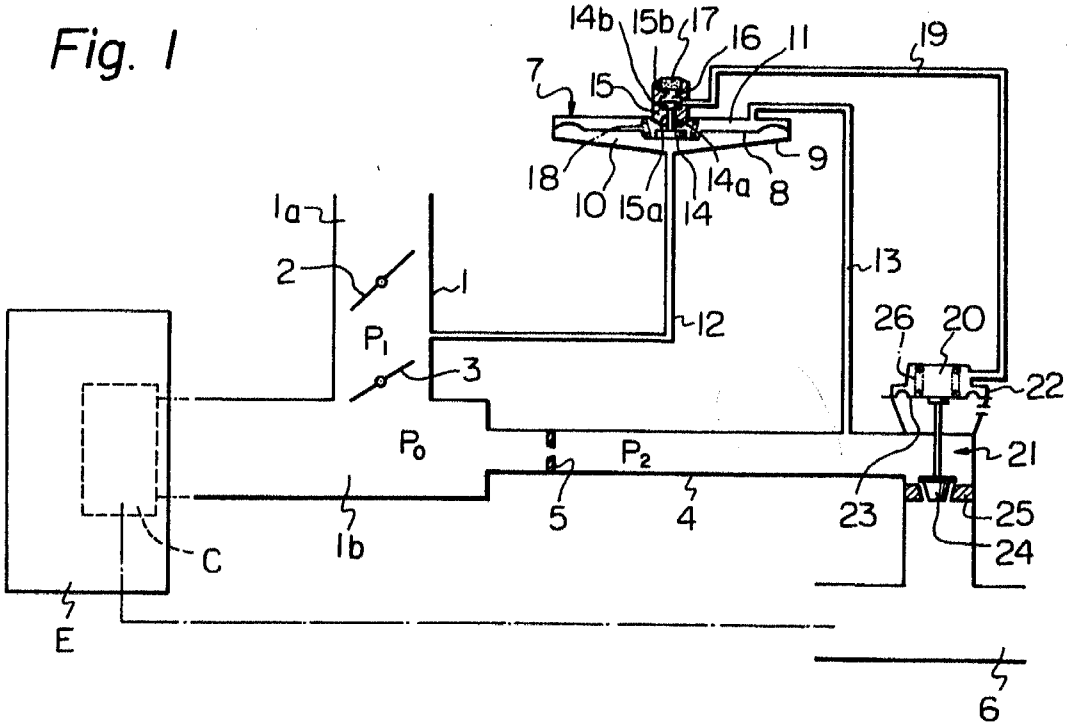
FIG. 1 is a schematic cross-sectional view of an EGR control system proposed by the applicant of the present application.

This applicant proposes a system shown in FIG. 1 as an EGR control system. In the system in FIG. 1, an intake passageway 1 is provided so that the combustion chambers C of an internal combustion engine E is communicable with the atmospheric air so as to supply intake air therethrough into the combustion chambers C. The intake passageway 1 includes a vertical portion 1*a* whose axis is vertical to an intake manifold 1*b* connected to the engine E. A throttle valve 2 is pivotally disposed in the vertical portion 1*a* to control the amount of the intake air supplied to the combustion chambers C of the engine E. A metering valve or control valve 3 of the flap valve type is pivotally disposed in the vertical portion 1*a* downstream of the throttle valve 2. This control valve 3 serves as a kind of variable orifice to control the cross-sectional area of the flow path for the intake air. The reference numeral 4 indicates an EGR gas passageway through which the intake passageway 1 is communicable with an exhaust system (no numeral) including an exhaust passageway 6 through which the exhaust gases from the combustion chamber C are discharged into the atmosphere. An orifice 5 is provided in the EGR gas passageway 4.

A pressure regulator valve assembly 7 or EGR control valve operating device includes a diaphragm member 8 which separates the interior of a casing 9 into two chambers 10 and 11. The chamber 10 is communicated through a passage 12 with the intake passageway 1 between the throttle valve 2 and the control valve 3. The chamber 11 is communicated through an passage 13 with the EGR gas passageway 4. A valve member 14 is secured to the diaphragm member 8 so as to move with the diaphragm member 8. The valve member 14 is formed with a stem portion 14*a* and a valve head portion 14*b*. The stem portion 14*a* is movably disposed in a cylindrical opening 15*a* of an air introducing section 15. The valve head portion 14*b* is movably disposed in a chamber 16 which is communicable through the opening 15*a* with the chamber 11 and with the atmospheric air through an air inlet opening 15*b* and an air filter 17. The valve member 14 is such arranged that the valve head portion 14*b* is selectively put into a first position at which the opening 15*a* is closed and the opening 15*b* is opened so that the chamber 16 communicates with the atmospheric air, and a second position in which the opening 15*a* is opened and the opening 15*b* is closed so that the chamber 16 communicates with the chamber 11. A spring 18 is disposed in the chamber 11 to bias the diaphragm member 8 in the direction that the valve head portion 15*a* closes the opening 15*a*. The chamber 16 is further communicable through a passage 19 with a vacuum operating chamber 20 of an EGR control valve assembly 21. The chamber 20 is defined in a casing 22 by a diaphragm member 23. A valve head 24 securely connected to a diaphragm member 23 is disposed to be seatable on a valve seat 25 securely disposed in the EGR gas passageway 4 upstream of the orifice 5. A spring 26 is disposed in the chamber 20 to bias the diaphragm member 23 in the direction that the valve head 24 seats on the valve seat 25 to block communication between the intake passageway 1 and the exhaust passageway 6.

Now, EGR rate is the rate of the amount of the recirculated exhaust gas relative to the amount of the intake air. The amount of the intake air is proportional to the opening area defined between the periphery of the control valve 3 and the inner wall surface of the intake passageway 1, and to a root of the pressure differential between upstream and downstream sides of the control valve 3. The amount of the recirculated exhaust gas is proportional to the opening area of the orifice 5, and to a root of the pressure differential between the uptream and downstream sides of the orifice 5. It is to be noted that the pressure $P_0$ downstream of the control valve 3 and the orifice 5 is common and at the same level. Accordingly, assuming that the opening degree of the control valve 3 is constant, the ratio of the pressure $P_1$ upstream of the control valve 3 and the pressure $P_2$ upstream of the orifice 5 corresponds to the ratio of the flow amounts of the intake air and the recirculated exhaust gas, using the ratio of the opening areas of the orifice defined by the valve 3 and the orifice 5 as a constant.

It will be understood that the EGR rate can be precisely controlled to a predetermined value when the pressures $P_1$ and $P_2$ are controlled to establish therebetween a predetermined pressure differential. Such a control of the pressure differential between the pressures $P_1$ and $P_2$ can be achieved by the EGR control valve assembly 21 which is controllably operated in accordance with the pressure applied to the control valve assembly 21, which pressure is prepared by the pressure regulator valve assembly 7.

With the thus arranged EGR control system, when the vacuum $P_1$ becomes higher than the vacuum $P_2$, the diaphragm member 8 is moved downward in the drawing so that the opening 15*a* is closed by the valve head portion 14*b* and the opening 15*b* is widely opened. Then, the vacuum supplied to the passage 19 is diluted with air introduced through the inlet opening 15*b* and therefore the diaphragm member 23 of the EGR control valve assembly 21 is forced downward in the drawing by the bias of the spring 26 to decrease the cross-sectional area of flow path of the recirculated exhaust gas defined between the valve head 24 and the valve seat 25.

Consequently, the action of the exhaust pressure to a portion of the EGR gas passageway 4 upstream of the orifice 5 is decreased, and the action of the engine intake vacuum $P_0$ to the same portion of the EGR gas passageway 4 is increased, so that the vacuum $P_2$ becomes higher along with the vacuum $P_1$. As a result, the pressure differential between the vacuums $P_1$ and $P_2$ is maintained to a predetermined level. It will be appreciated that when such a pressure differential is maintained constant (particularly at zero), the ratio between the intake air and the recirculated exhaust gas is also maintained constant.

On the contrary, the vacuum $P_2$ becomes higher than the vacuum $P_1$, the valve head portion 14*b* of the valve member 14 closes the opening 15*b* so that the opening 15*a* is opened. Then, the vacuum applied to the chamber 11 is supplied to the chamber 16 and accordingly the vacuum supplied to the passage 19 becomes higher. This moves the diaphragm member 23 of the EGR control valve assembly 21 in the upward direction in the drawing to increase the cross-sectional area defined between the valve member 24 and the valve seat 25.

Consequently, the vacuum $P_2$ upstream of the orifice 5 becomes lower to control the pressure differential between the vacuums $P_1$ and $P_2$ to a constant value. As a result, the EGR rate is controlled in proportion to the increase and decrease in the amount of the intake air, and therefore the EGR rate can be precisely controlled constant.

Now, in case in which a required EGR rate is varied in accordance with engine operating conditions, the EGR rate can be varied by varying the opening degree of the control valve 3 even if the pressure differential between the upstream and downstream sides of the control valve 3 is in the same relationship as the pressure differential between the upstream and downstream sides of the orifice 5. As the opening degree of the control valve 3 increases, the rate of the intake air increases to lower EGR rate. In this regard, for example during high speed and load engine operation, it is requred to widely open the control valve 3 in order to obtain sufficient engine power output at full throttle.

As appreciated above, according to the EGR control system of the type shown in FIG. 1, the EGR rate can be precisely controlled in accordance with the engine operating conditions. However, such EGR control system encounters the problems in that uniform distribution of air-fuel mixture into a plurality of engine cylinders cannot be attained since a butterfly or flap valve is used as the control valve 3. In general, the distance of the vertical portion 1*b* downstream of the throttle valve 2 is considerably short. Additionally, in case using the butterfly valve as the control valve 3, a uniform opening can not be formed between the periphery of the control valve 3 and the inner wall surface of the intake passageway 1. Therefore, air and fuel cannot be homogeneously mixed and inhomogeous air-fuel mixture is supplied to the branch runners of the intake manifold 1*b*. As a result, uniform air-fuel mixture cannot be supplied to each engine cylinder, which causes unstable engine running, degrading the driveability of a motor vehicle.

In view of the above, the present invention contemplates to solve the above-mentioned problems encountered in the EGR control system of the type wherein a butterfly valve is used as the control valve 3 for controlling the EGR rate in accordance with engine operating conditions.

Figure 2:
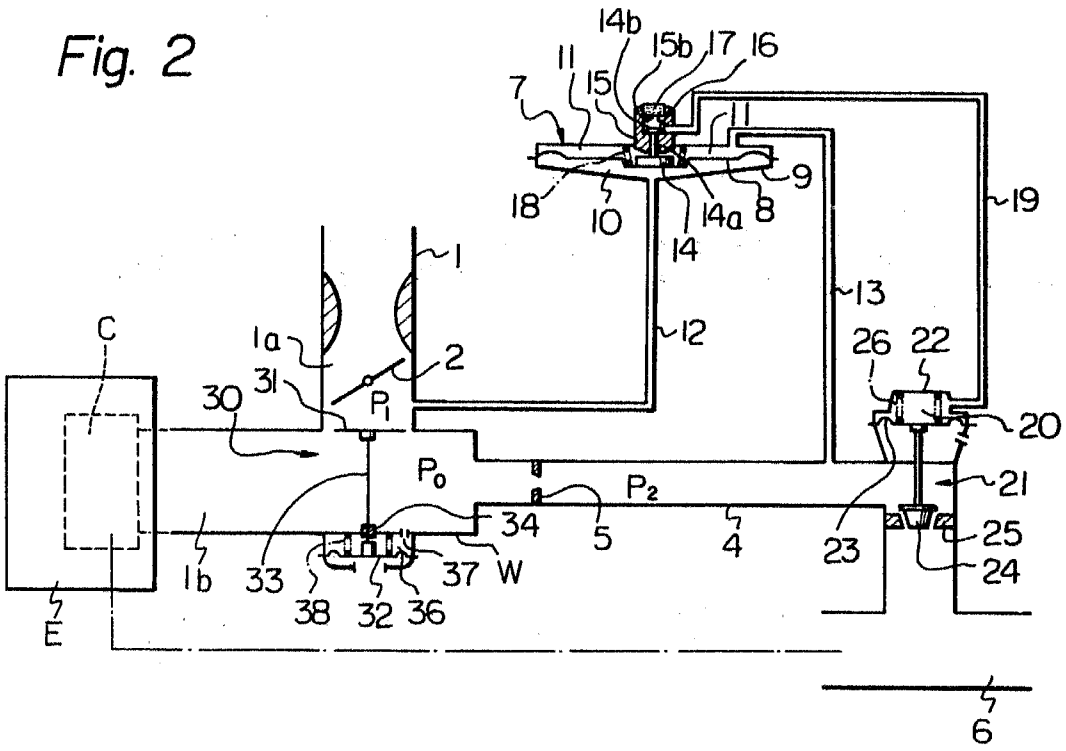
FIG. 2 is a schematic cross-sectional view of a first embodiment of an EGR control system in accordance with the present invention.

Referring now to FIG. 2, a first embodiment of the EGR control system in accordance with the present invention is shown, which is similar to the system of FIG. 1 except for a control valve assembly 30 for controlling the EGR rate in accordance with engine operating conditions. The control valve assembly 30 includes a control valve member 31 of the disc type, which valve member 31 is movably disposed in the intake passageway 1 and located adjacent the connecting portion of the vertical portion 1*a* with the intake manifold 1*b*. As shown, the vertical portion 1*a* of the intake passageway 1 is connected to the intake manifold 1b in such a manner that the axis of vertical portion 1a is substantially perpendicular to the intake manifold 1b. It is to be noted that the diameter of the valve member 31 is smaller than the diameter of the vertical portion 1a of the intake passageway 1 and accordingly the valve member 31 is insertable into the vertical portion 1a. The valve member 31 is connected to a diaphragm member 32 through a valve stem 33 secured at its one end to the center of the valve member 31. As seen, the valve stem 33 extends downwardly in parallel with the axis of the vertical portion 1a and passes through the bottom wall W of the intake manifold 1b through a bearing 34 secured to the bottom wall W. The valve stem 33 is slidably supported by the bearing 34 to move in axial direction of the vertical portion 1a.

The diaphragm member 32 defines a chamber 36 which communicates with the interior of the intake manifold 1b through a vacuum inlet opening 37 formed through the bottom wall W of the intake manifold 1b. A spring 38 is disposed in the diaphragm chamber 36 to bias the diaphragm member 32 downward in the drawing.

With the arrangement of FIG. 2, an annular opening is defined around the periphery of the control valve member 31 and accordingly air-fuel mixture prepared by a carburetor (only its venturi is shown) is inducted through all the annular opening and uniformly distributed into the branch runners (not shown) of the intake manifold 1b.

As the intake manifold vacuum decreases, the diaphragm member 32 is moved downward in the drawing by the bias of the spring 38, which moves the control valve member 31 downward in the drawing so that the opening degree of the valve member 31 increases. Therefore, at high speed and load engine operating range, the amount of the intake air increases relative to the recirculated exhaust gas supplied through the EGR gas passageway 4, which decreases the EGR rate. Besides, since the air flow resistance due to the control valve member 31 is decreased, the engine power output at full throttle is sufficiently increased.

At low and medium load engine operating range, the intake manifold vacuum increases and consequently the control valve member 31 moves upward in the drawing, decreasing the opening degree of the control valve member 31. As a result, the EGR rate is increased.

Figure 3:
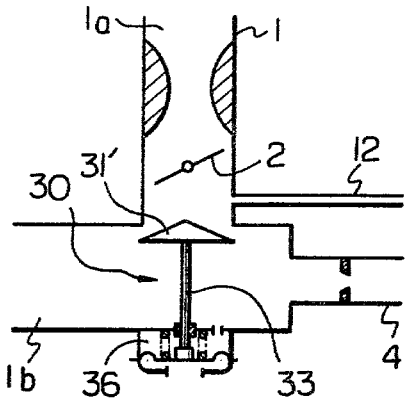
FIG. 3 is a schematic cross-sectional view of the essential part of a second embodiment of an EGR control system in accordance with the present invention.

FIG. 3 illustrates the control valve assembly 30 including valve member 31′ of the flat cone shape, of a second embodiment of the EGR control system according to the present invention. The valve member 31a may be larger in diameter than the vertical portion 1a of the intake passsageway 1. Such an arrangement is advantaneous since the opening area defined around the valve member 31a can be smoothly and continuously varied.

Figure 4:
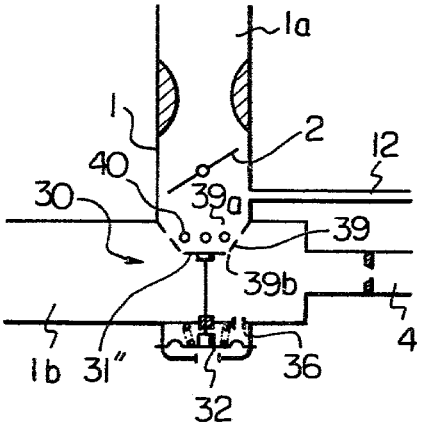
FIG. 4 is a cross-sectional view similar to FIG. 3, but showing the essential part of a third embodiment of the EGR control system in accordance with the present invention.

FIG. 4 illustrates the essential part of a third embodiment of the EGR control system in accordance with the present invention, which comprises a frustoconical guide member 39 which is formed with upper and lower ends 39a and 39b. The upper end 39a is larger in diameter than the lower end 39b. As shown, the upper end 39a is securely connected to a member (no numeral) defining therein the vertical portion 1a of the intake passageway 1. The control valve member 31″ is smaller in diameter than the lower opening 39b of the guide member 39. The guide member 39 is formed with a plurality of openings 40 which are located equidistantly along the outer periphery of the guide member 39.

With this arrangement, the air-fuel mixture prepared by the carburetor is inducted uniformly through the plurality of openings 40 into the intake manifold 1b, and therefore the air-fuel mixture is uniformly introduced into the plurality of the branch runners of the intake manifold 1b, preventing unbalanced distribution of fuel into each engine cylinders.

Figure 5:
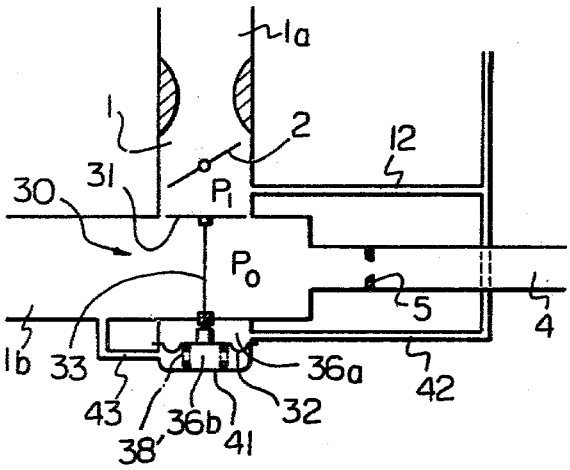
FIG. 5 is a cross-sectional view similar to FIG. 3, but showing the essential part of a forth embodiment of the EGR control system in accordance with the present invention.

FIG. 5 illustrates the essential part of a fourth embodiment of the EGR control system in accordance with the present invention, which is such arranged that the control valve member 31 is operated in accordance with the pressure differential between the upstream and downstream sides of the valve member 31. In this embodiment, the diaphragm 32 separates the interior of a diaphragm casing 41 into an upper chamber 36a and a lower chamber 36b. The upper chamber 36a is communicated through a passage 42 with the passage 12 so that the chamber 36a is supplied with the pressure $P_1$ in the intake passageway 1 between the throttle valve 2 and the control valve member 31. The lower chamber 36b is communicated through a passage 43 with the interior of the intake manifold 1a so that the chamber 36b is supplied with the pressure $P_0$ or intake manifold vacuum in the intake passageway downstream of the control valve member 31. In this instance, the spring 38′ is disposed in the lower chamber 36b so as to bias the diaphragm member 32 upward in the drawing.

With this arrangement, at the low and medium load engine operating range in which the operating degree of the throttle valve 2 is less and the amount of the intake air is less, the pressure drop between upstream and downstream sides of the control valve member 31 is less and accordingly the pressure difference therebetween is also less. As a result, the opening degree of the control valve member 31 is maintained less to obtain a desired EGR rate.

At the high speed and load engine operating condition, the amount of the intake air increases to increase the pressure differential between the upstream and downstream sides of the control valve member 31. Accordingly, the diaphragm member 32 is moved downward in the drawing, increasing the opening degree of the control valve member 31. As a result, sufficiently high power output is obtained at full throttle. It will be understood that the response of the control valve member 31 is improved in this instance, since the valve member 31 is operated in response to the difference between two pressures $P_1$ and $P_0$.

Figure 6:
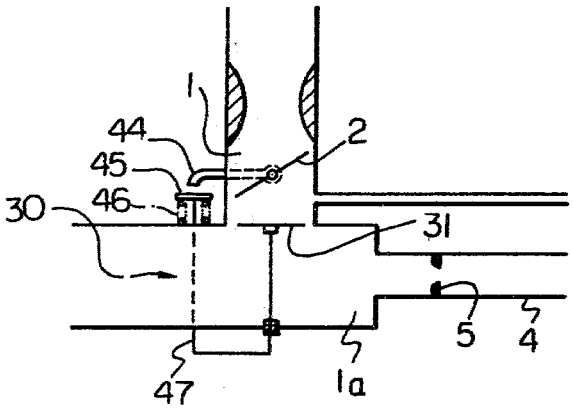
FIG. 6 is a cross-sectional view similar to FIG. 3, but showing the essential part of a fifth preferred embodiment of the EGR control system in accordance with the present invention.

FIG. 6 illustrates the essential part of a fifth embodiment of the EGR control system in accordance with the present invention, which is such arranged that the control valve member 31 is compulsorily opened to decrease the flow resistance of the intake air when the opening degree of the throttle valve exceeds a predetermined level.

The EGR control system of this instance comprises a throttle lever 44 which is secured to a throttle shaft (no numeral) on which the throttle valve is securely mounted, so that the throttle lever 44 is rotatable with the throttle valve 2. The throttle lever 44 is constructed and arranged to push a flat member 45 downward in the drawing, against the bias of a spring 46 which is disposed to bias the flat member 45 upward in the drawing. A U-shaped rod member 47 is formed with two ends one of which is secured to the flat member 45 and the other secured to the control valve member 31.

With this arrangement, when the opening degree of the throttle valve 2 does not reach the predetermined level, the EGR rate is maintained constant. However, when the opening degree of the throttle valve 2 exceeds the predetermined level, the throttle lever 44 pushes down the flat member 45 against the bias of the spring 46. Then, the U-shaped rod member 47 is moved downward in the drawing to move the control valve member 31 downward in the drawing. As a result, the opening, degree of the valve member 31 is increased to decrease the EGR rate.

As appreciated from the above, according to the present invention, uniform distribution of air-fuel mixture to each engine cylinders of a multi-cylinder engine can be effectively achieved, preventing unbalance in power outputs among engine cylinders. Besides, the precise control of exhaust gas recirculation can be improved without causing the deterioration in engine power output at full throttle under high speed and load engine operating condition.

What is claimed is:

1. An exhaust gas recirculation (EGR) control system for an internal combustion engine having a combustion chamber, comprising:

means defining an intake passageway communicable with the combustion chamber to introduce intake air therethrough into the combustion chamber, said intake passageway being provided therein with a throttle valve;

means defining an exhaust gas passageway communicable with the combustion chamber to discharge exhaust gas therethrough into the atmosphere;

means defining an EGR gas passageway through which said intake passageway and said exhaust gas passageway is communicable, said EGR gas passageway being provided therein with an orifice;

and EGR control valve disposed in said EGR gas passageway upstream of said orifice to control the amount of the exhaust gases recirculated back to the combustion chamber through said EGR gas passageway;

means for operating said EGR control valve in accordance with the relationship between the pressure in the intake passageway downstream of said throttle valve and the pressure in said EGR gas passageway between said orifice and said EGR control valve; and control valve means including a valve member which is disposed in said intake passageway downstream of said throttle valve and movable in the axial direction of a portion of said intake passageway to control the flow resistance of the intake air passing through said intake passageway.

2. An EGR control system as claimed in claim 1, in which said control valve means includes means movable in accordance with an engine load condition and mechanically connected to said valve member to move said valve member with said movable means.

3. An EGR control system as claimed in claim 2, in which said portion of said intake passageway is angularly connected to an intake manifold.

4. An EGR control system as claimed in claim 3, in which said movable means includes a diaphragm member on which intake vacuum in said intake passageway acts, said diaphragm member being connected through a rod member to said valve member, said valve member being movable relative to said portion of said intake passageway.

5. An EGR control system as claimed in claim 3, in which said movable means includes a diaphragm member having a first side surface receiving the intake vacuum of said intake passageway between said throttle valve and said valve member, and a second side surface receiving the intake vacuum in said intake passageway downstream of said valve member of said control valve means, said diaphragm member being connected through a rod member to said valve member of said control valve means.

6. An EGR control system as claimed in claim 3, in which said movable means includes a throttle lever movable in accordance with the opening degree of said throttle valve, said throttle lever being mechanically connectable with said valve member of said control valve means.

7. An EGR control system as claimed in claim 4, in which said valve member is of the disc type and defines an annular opening between its periphery and the peripheral surface of said portion of said intake passageway, said rod being movable in the axial direction of said portion of said intake passageway.

8. An EGR control system as claimed in claim 4, in which said valve member is of the flat conical shape and defines an annular opening between its surface and the peripheral surface of said portion of said intake passageway, said rod member being movable in the axial direction of said portion of said intake passageway.

9. An EGR control system as claimed in claim 4, in which said control valve means further includes a frustoconical guide member secured to said intake passageway defining means and defining thereinside an air-fuel mixture guide passage for guiding air-fuel mixture from said portion of said intake passageway to said intake manifold, said guide member being formed with a plurality of openings through which said air-fuel mixture guide passage is communicated with the interior of the intake manifold, said valve member being movable relative to said air-fuel mixture guide passage.

10. An EGR control system as claimed in claim 5, in which said valve member is of the disc type and defines an annular opening between its periphery and the peripheral surface of said portion of said intake passageway, said rod member being movable in the axial direction of said portion of said intake passageway.

11. An EGR control system as claimed in claim 6, in which said control valve means includes connecting means for operatively connecting said throttle lever with said valve member, said connecting means including a U-shaped rod member having a first end secured to said valve member and a second end to which a flat member is secured, said throttle lever being contactable with said flat member to push said flat member so as to move said valve member through said U-shaped rod member.

12. An EGR control system as claimed in claim 1, in which said EGR control valve includes a diaphragm member, and a valve head securely connected to said diaphragm member and movable in accordance with the pressure applied on said diaphragm member.

13. An EGR control system as claimed in claim 12, in which said operating means includes a diaphragm member having a first surface receiving the pressure in said EGR gas passageway between said orifice and said EGR control valve, and a second surface receiving the pressure in said intake passageway between said throttle valve and said valve member of said control valve means, and valve means for selectively applying atmospheric pressure and the pressure in said EGR gas passageway between said orifice and said EGR control valve onto said diaphragm member of said EGR control valve, in response to the movement of said diaphragm member of said operating means.

14. An EGR control system as claimed in claim 13, in which said valve means includes means defining a pressure control chamber, an air inlet opening through which said pressure control chamber communicates with the atmosphere, and a vacuum inlet opening through which said pressure control chamber communicates with a chamber defined by the first surface of said diaphragm member of said operating means, said pressure control chamber communicating with a chamber defined by said diaphragm member of said EGR control valve, and a valve member formed with a valve head disposed in said pressure control chamber and a valve stem securely connecting said valve head with said diaphragm member of said operating means, said valve stem being movably disposed in said vacuum inlet opening, said valve head selectively closing said air inlet opening and said vacuum inlet opening in response to the movement of said diaphragm member of said operating means.

* * * * *